US009402488B2

(12) United States Patent
Morrish

(10) Patent No.: US 9,402,488 B2
(45) Date of Patent: Aug. 2, 2016

(54) PICTURE DISPLAY AND MOUNTING

(71) Applicant: MILLBROOK MOULDINGS, Newtown, Powys (GB)

(72) Inventor: Mark Morrish, Newtown (GB)

(73) Assignee: MILLBROOK MOULDINGS, Newtown (GB)

( * ) Notice: Subject to any disclaimer, the term of this patent is extended or adjusted under 35 U.S.C. 154(b) by 0 days.

(21) Appl. No.: 14/676,138

(22) Filed: Apr. 1, 2015

(65) Prior Publication Data

US 2016/0073797 A1 Mar. 17, 2016

(30) Foreign Application Priority Data

Sep. 16, 2014 (GB) ..... 1416361.2
Sep. 17, 2014 (GB) ..... 1416461.0
Feb. 17, 2015 (GB) ..... 1502615.6

(51) Int. Cl.

*A47G 1/16* (2006.01)
*A47G 1/14* (2006.01)
*B31F 1/00* (2006.01)
*A47G 1/06* (2006.01)

(52) U.S. Cl.

CPC ..... *A47G 1/16* (2013.01); *A47G 1/0633* (2013.01); *A47G 1/141* (2013.01); *B31F 1/0016* (2013.01); *B31F 1/0051* (2013.01)

(58) Field of Classification Search

CPC ..... A47G 1/0633; A47G 1/141; G09F 1/12; B31F 1/0016

See application file for complete search history.

(56) References Cited

U.S. PATENT DOCUMENTS 1,262,508 A * 4/1918 Kaufman ..... A47G 1/0633 229/167
1,331,009 A * 2/1920 Ford ..... A47G 1/0633 229/168
2,250,491 A * 7/1941 Lurrain ..... A47G 1/06 206/586
2,395,369 A * 2/1946 Burr ..... A47G 1/0633 40/788
3,214,855 A * 11/1965 Winkler ..... A47G 1/0633 40/788

(Continued)

FOREIGN PATENT DOCUMENTS

DE 20 2004 019 859 U1 3/2005
DE 20 2012 007 160 U1 8/2012

(Continued)

OTHER PUBLICATIONS

Jan. 26, 2016 Search Report issued in European Application No. 15 000 492.7.

*Primary Examiner* — Gary Hoge
(74) *Attorney, Agent, or Firm* — Oliff PLC

(57) ABSTRACT

A picture mounting has: a web having a display panel which has a display surface on its front face, the display panel having a perimeter defined by a frame having a plurality of spars; each spar being made of leaves created from the web and extending from the perimeter of the display panel, each of the leaves being folded at least twice, in a rearward direction to create a spar having a polygonal cross-section; each spar having an adhesive region located on a surface of one of the leaves and by means of which a picture is adhered to the respective spar; the spars being mutually interlocking thereby to retain the spars adjacent the rear surface of the display surface and thereby to create the frame.

16 Claims, 8 Drawing Sheets

(56) References Cited

U.S. PATENT DOCUMENTS

| | | | | | |
|---|---|---|---|---|---|
| 4,870,766 | A * | 10/1989 | Topping | G09F 1/12 | 40/788 |
| 5,359,794 | A * | 11/1994 | Wood | G09F 1/12 | 40/789 |
| 5,365,684 | A * | 11/1994 | Cartmell | G09F 1/12 | 40/788 |
| 5,513,455 | A * | 5/1996 | Walker | G09F 1/06 | 40/788 |
| 2002/0144445 | A1 * | 10/2002 | Gomez del Campo Diaz Barrerio | G09F 1/12 | 40/788 |
| 2011/0016759 | A1 * | 1/2011 | Ramos-Gonzalez | A47G 1/0633 | 40/773 |
| 2012/0297653 | A1 | 11/2012 | Ridless et al. | | |
| 2013/0055609 | A1 | 3/2013 | Ridless et al. | | |
| 2013/0227868 | A1 * | 9/2013 | Edmondson | A47G 1/0633 | 40/743 |

FOREIGN PATENT DOCUMENTS

| | | | | | |
|---|---|---|---|---|---|
| GB | 965390 | A | | 7/1964 | |
| GB | 2457005 | A | * | 8/2009 | A47G 1/141 |
| GB | 2461863 | A | * | 1/2010 | A47G 1/0633 |
| GB | 2505442 | A | | 3/2014 | |
| WO | 2011010085 | A2 | | 1/2011 | |
| WO | 2011/042593 | A1 | | 4/2011 | |

* cited by examiner

PICTURE DISPLAY AND MOUNTING

BACKGROUND TO THE INVENTION

1. Field of the Invention

The present invention relates to the display of an image recorded on some hard copy medium.

Hard copy images or 'pictures' are typically displayed hanging from a wall or other fixture, or standing upright upon items of furniture. Displaying pictures in this way usually requires the picture to have a degree of structural rigidity. Pictures comprising flexible webs, such as canvas or paper carrying an image therefore usually have to be mounted upon a suitable structure or 'mounting' to enable them to be displayed in that manner.

2. Description of Related Art

It is known to create inexpensive and relatively easily constructed picture mountings, typically from cardboard. Typically, such a mounting will comprise a flat, usually square or rectangular display panel and a frame at its rear. Adhesive, usually self-adhesive, is located on the front face of the display panel and a picture such as a photograph or drawing can be stuck to the display panel by removing the release paper from the self-adhesive and placing the picture in the correct position then pressing to cause it to adhere to the exposed adhesive. One feature of this design is that precise alignment of the picture and display panel are required; the nature of the self-adhesive being such that removal and re-alignment is difficult at best and, more usually will result in damage to the picture, mounting or both.

WO2011010085 discloses a display mount for artwork with a central rectangular area which is coincident with the image to be displayed and which is coated with adhesive.

SUMMARY OF THE INVENTION

Embodiments of the present invention provide alternatives which enable easy alignment and adhesion of a picture to a mounting. Preferred embodiments provide a mounting which enables self-tensioning of a picture on the mounting.

BRIEF DESCRIPTION OF DRAWINGS

Embodiments of the present invention will now be described, by way of example, and with reference to the accompanying drawings, in which.

DESCRIPTION OF PREFERRED EMBODIMENTS

According to one embodiment of the present invention, a mounting will typically be used to retain a picture for display.

Typically, the picture, that is to say an image such as a drawing, painting or photograph recorded on a hard copy medium such as paper, canvas or photographic paper, will lack or have only minimal rigidity; and will therefore be poorly adapted, structurally speaking, to display whatever image it records. Accordingly, a mounting serves, for example, to provide both structural integrity and permit the fixing of the picture to—say—a wall.

Figure 1:
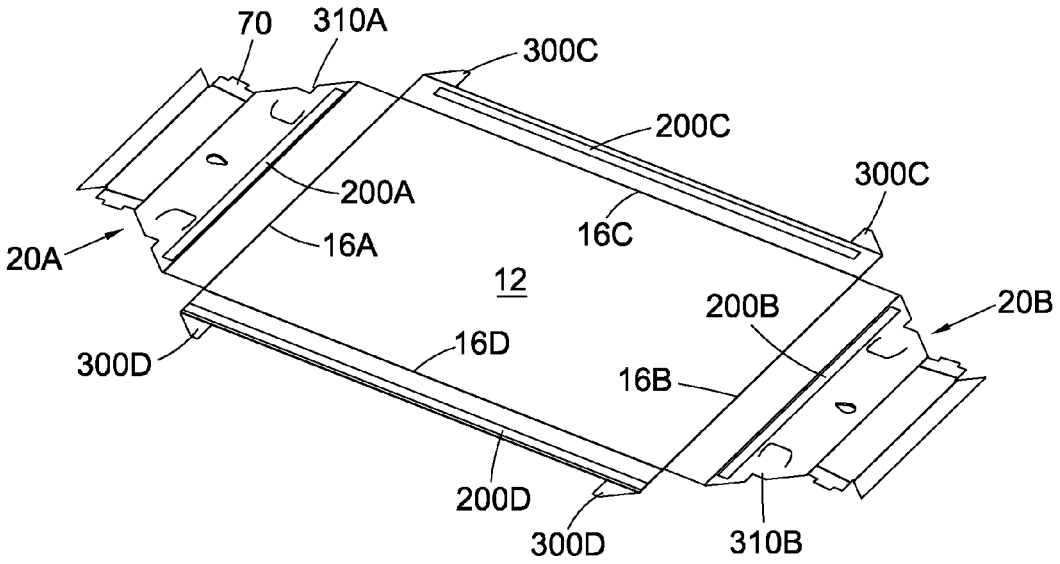
FIG. 1 is a perspective view, from a first side, of a mount according to an embodiment of the present invention.
Figure 2:
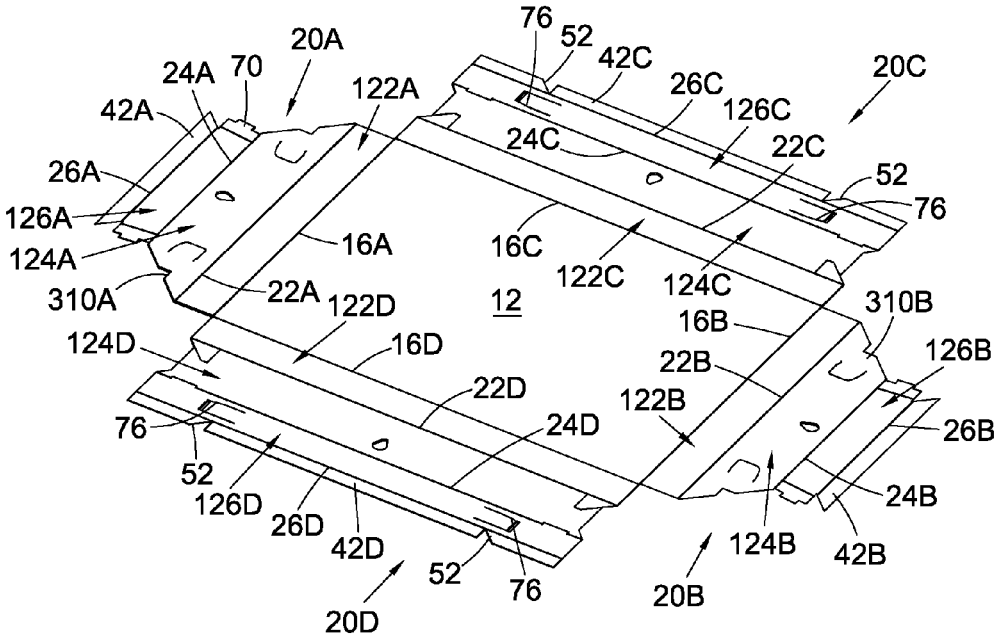
FIG. 2 is a perspective view from the opposite side shown in FIG. 1.

Referring to FIGS. 1 and 2, the picture mounting 10 is, in the present example, fashioned from a web of material which typically (though not essentially, since the mounting may serve only to provide the capacity to mount the picture to a wall, for example) has greater rigidity than that of the picture which it is to display. Thus, for example, in one embodiment, the material of the web used to create the mounting is cardboard, or a material having similar characteristics.

As shown in FIG. 1, the mounting 10 includes a central display panel 12, which in the present embodiment is rectangular, though other geometries such as triangular, square, pentagonal are possible. In use, a picture will be retained against the front-facing, 'display surface' of the display panel, this being the side of the display panel visible in FIG. 1. In a modification, a part of the display surface of the display panel is cut out so that, in the absence of a picture mounted over it, it has the appearance of a frame, the display surface thereby only being peripheral in nature. The perimeter of the display panel is defined by a frame formed of a plurality of spars, formed from leaves extending outwardly from it. In the present embodiment, each spar is created from the same material as the display panel 12, though the attachment of distinct material to create spars is envisaged. Four fold lines 16A-D at the perimeter of the display panel 12 are the starting point, from which four leaves that form the spars, 20A-D, B extend.

Figure 3:
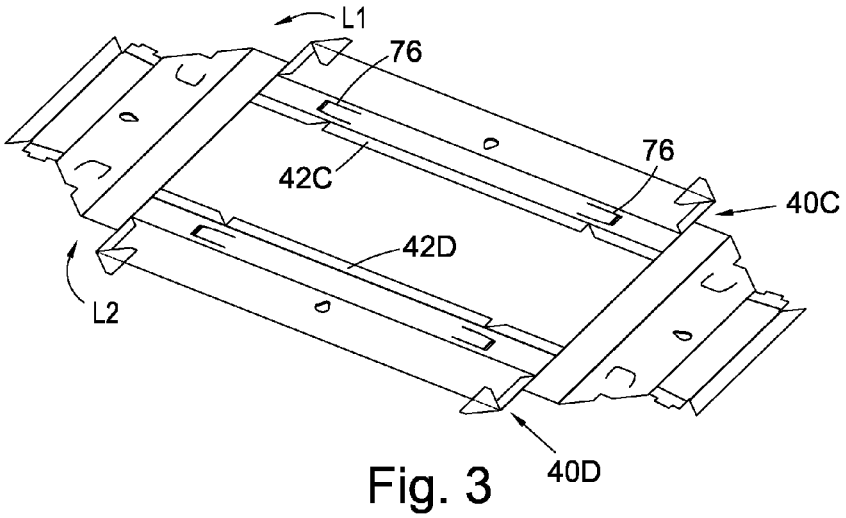
FIGS. 3 to 7 are perspective views of various stages of assembly of a mount according to an embodiment of the present invention.
Figure 4:
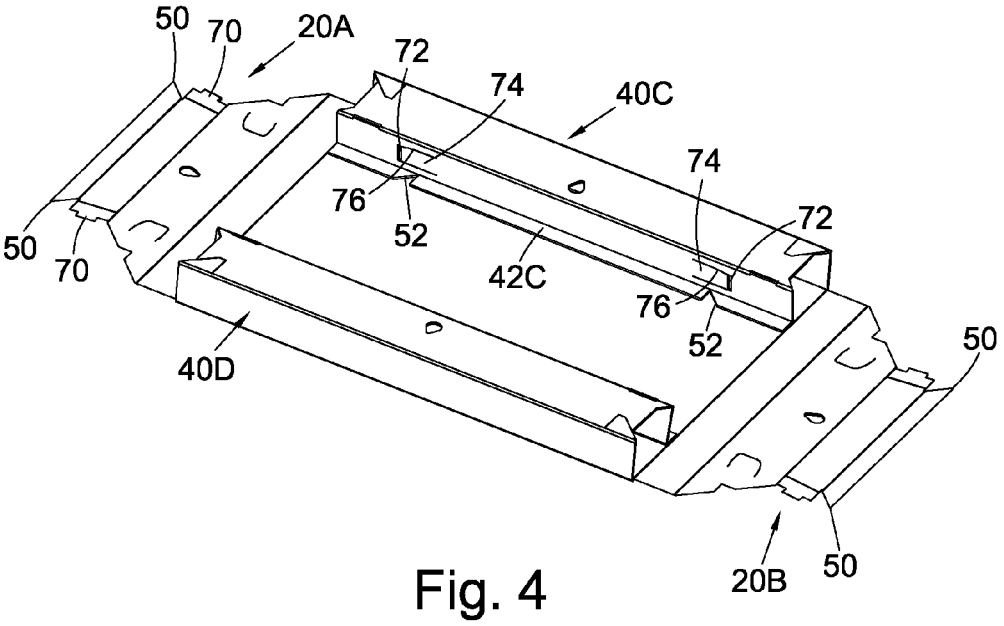

Referring specifically to FIG. 2, each of the leaves includes three further fold lines 22A-D, 24A-D, 26A-D. Thus, the fold lines 16A-D and 22A-D define first sub-leaves; the fold lines 22A-D define second sub-leaves located on the distal side of the display panel from the first sub-leaves; and the fold lines 124A-D and 126A-D define third sub-leaves, located on the distal side of the display panel from the second sub-leaves. Strengthening spars having, in the present example, a rectangular cross-section (the geometry of the cross section being determined by the number of sub-leaves), are created by folding the leaves 20A to D rearwardly i.e. in a direction towards the rear surface of the display panel (this being the side of the display panel 12 visible in FIG. 2) along each of the three fold lines. Referring additionally to FIG. 3, the spars 40C, D which extend along the long side of the rectangular display panel 12 can be seen. In one preferred embodiment shown in FIG. 3, the spars 40C, D shown in FIG. 3 are created by the adhesion of the distal elements 42C, D of the leaves 20C, D respectively to the rear surface of the display panel. This enables the spars 40C, D to be folded flat once adhered in this way. Thus, the mounting when constructed in this manner, prior to shipping to customers, may still be shipped flat but with spars 40C, D already folded rearwardly and adhered to the rear face of the display panel, providing quicker and more precise assembly. The spars 40C, D are then able to adopt a proper rectangular cross section by folding them upwards along the arcs of the lines L1 and L2 in FIG. 3 (in the drawing of FIG. 3, the spars 40C, D are partly unfolded along the lines L1 and L2 and therefore have a cross-section akin to a parallelogram). Full unfolding results in the spars 40C, D attaining the preferred rectangular cross section, as illustrated in FIG. 4.

Figure 5:
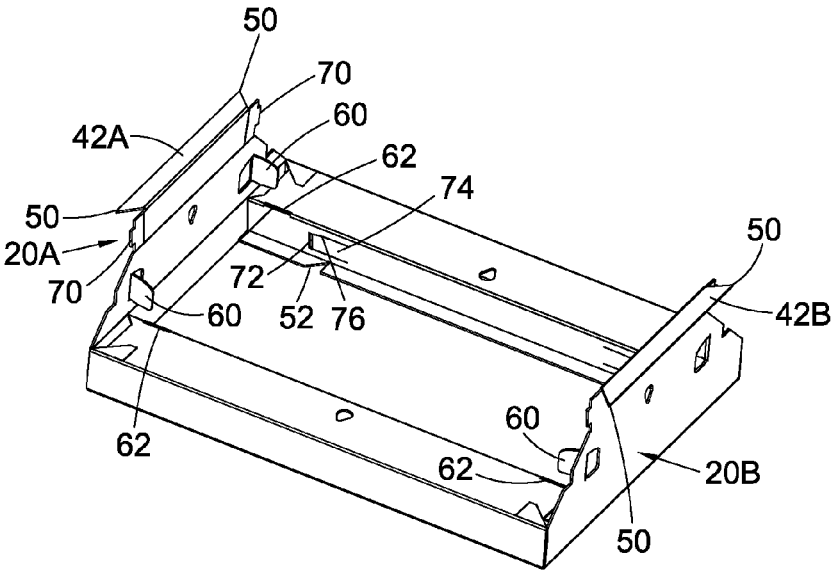
Figure 6:
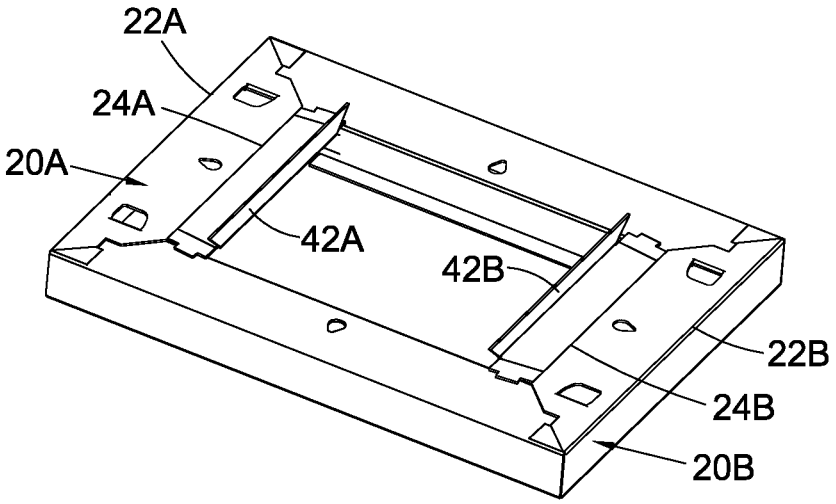
Figure 7:
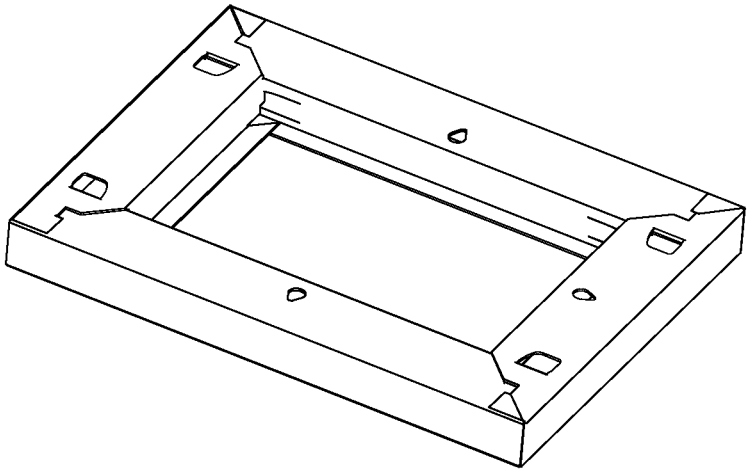
Figure 8:
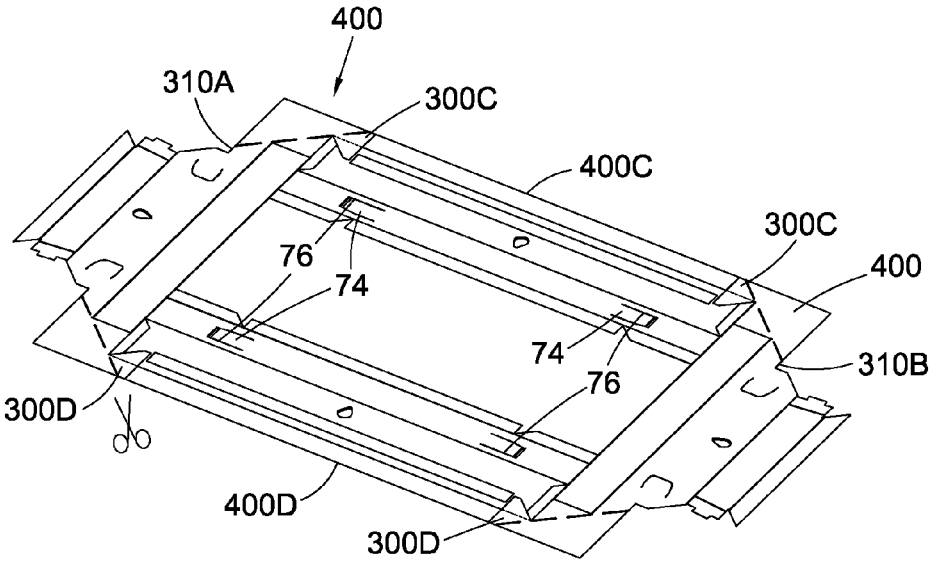
FIGS. 8 to 11 are perspective views of various stages of assembly of a mount according to an embodiment of the present invention in conjunction with the mounting of a flexible web displaying a picture.

FIGS. 4 to 7 show the stages of creation of the spars 40A, B from the leaves 20A, B. Thus, in FIG. 5, the leaves 20A, B are folded rearwardly (i.e. towards the rear surface of the display panel 12 visible in FIG. 5, though this is also vertical in FIG. 5) along the line 16A, B defining the perimeter of the display panel 12 and the distal sub-leaves 42A, B are folded outwardly. In FIG. 6 the leaves 20A, B are then folded rearwardly along the lines 22A, B. In FIG. 7, the leaves 20A, B are then folded inwardly along the lines 24A, B.

A number of detent mechanisms come into mutual engagement to cause the spars 40A, B created from the leaves 20A, B to interlock with the spars 40C, D. First, flaps 60 which project from the sub-leaves 124A, B enter correspondingly shaped slots 62 in the spars 40C, D. Secondly, lugs 70, which project outwardly from the sub-leaves 126A, B engage with correspondingly shaped slots 72 in the spars 40C, D. In connection with this engagement, flaps 74 (created by suitable cuts in the spars 40C, D) provide a leaf bias springs. These flaps bend inwards under the force of the lug 70 moving towards the slot 72, thereby to permit the lugs 70 move into the slots 72 without damage to the lugs 70. And, once the lugs 70 have engaged in the slots 72, the flaps 74 spring outwardly to retain the lugs 70 securely in the slots 72. Further, and as illustrated in FIGS. 2, 4 and 5, for example, the cuts 76 in the sub-leaves 126C, D ,which serve to create the flaps 74, have slightly curved upper surfaces. That curvature is oriented such that, when the spars 40C,D are formed, as the surfaces 76 extend outwardly, towards the spars 40A, B, their curvature increases so that they increasingly approach the rear face of the display panel 12. This curved configuration serves to operate upon the upper surfaces of the lugs 70 in the manner of a cam, with the result that, as the lugs 70 are folded towards the slots 72, they (and therefore also the sub leaves 12A, B) are drawn downwardly, towards the rear face of the display panel 12. This serves to provide additional tension and therefore rigidity into the spars 40A, B when they are located in position. Finally, outwardly projecting tapered tips 50 are located on the distal sub-leaves 42A, B and engage with correspondingly-shaped notches 52 formed in the distal leaves 42C, D.

The assembled mount is shown in FIG. 7, with the spars 40A, B fully interlocked with the spars 40C, D thereby to define the display panel 12, the rear surface of which is seen in FIG. 7.

Referring again to FIG. 1 and, additionally to FIGS. 8 to 11, a picture is retained on the mounting by means of attachment of the periphery of the picture with attachment regions on the leaves 20A to D. In the present embodiment, that attachment is by means of strips 200A, D of adhesive (typically, though not necessarily, self-adhesive), located on the leaves 20A, D respectively; in the present embodiment, the second sub-leaves. These strips adhere to the periphery of the picture, though other attachment mechanisms are possible, one of which will be disclosed subsequently in connection with an alternative embodiment. The process will now be described by reference to FIGS. 8 to 11. The picture 400 is laid on a flat surface, face down. The mounting, unassembled is then placed on top of the picture 400. The picture 400 and mounting are then brought into mutual alignment. This is done using alignment surfaces on one or more of the leaves 20A to D which enable the picture to be suitably located and aligned prior to attachment, which in the present embodiment is by adhesion.

In the present embodiment, there are four such alignment surfaces provided by the tips 300C, D which project outwardly from leaves 20C, D, and the notches 310A, B in the leaves 20A, B. Alignment is therefore achieved by bringing the tips 300C, D into coincidence with the corresponding edges 400C, D (i.e. of the long side) of the picture 400, the notches 310A, B in the leaves 20A, B are aligned with the corresponding, short-sided edges of the picture 400. If desired, at this point, cuts may be made in the corners of the picture 400 along the lines indicated by the dashed lines in FIG. 8.

Figure 9:
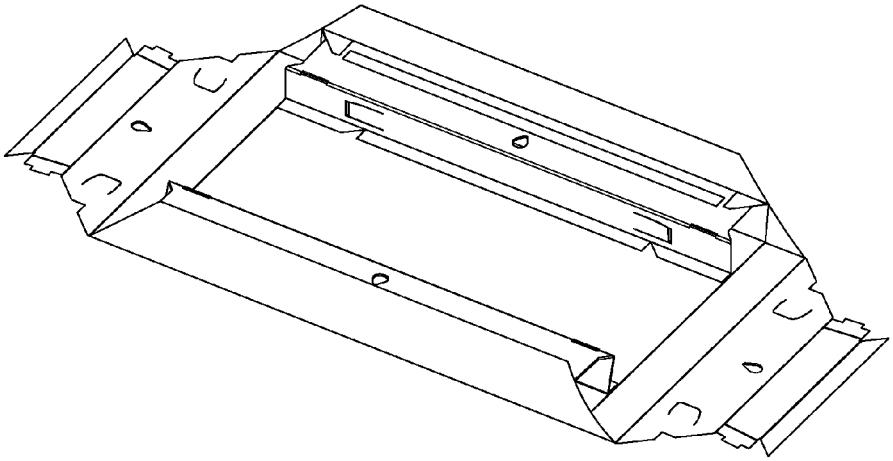
Figure 10:
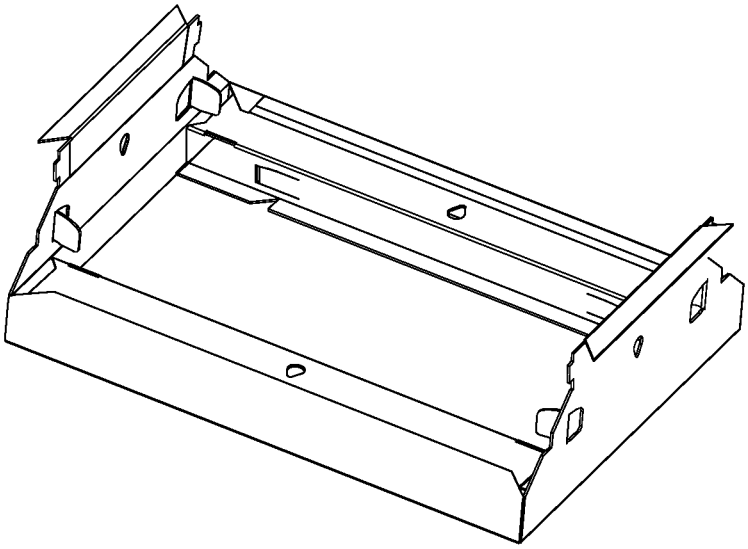
Figure 11:
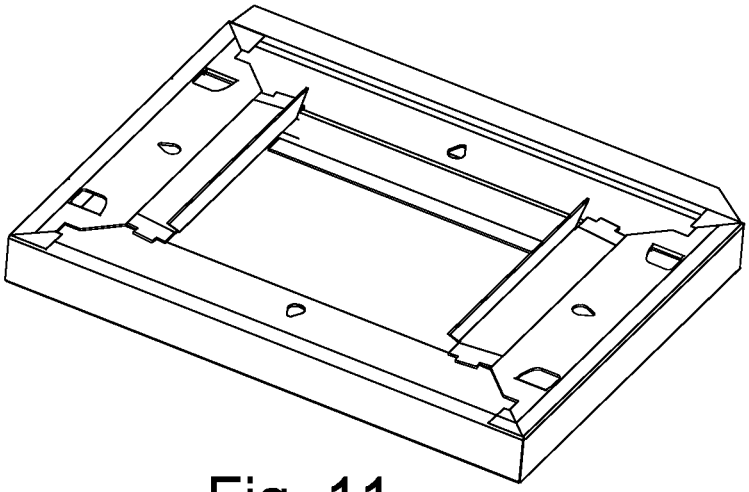

The release paper is then removed from the strips 200C, D of adhesive and the picture 400 is folded into contact with the adhesive strips 200C, D. The release paper is then removed from strips of adhesive 200A, B to cause the corresponding edges of the rear surface of the picture 400 to adhere to the leaves 20A, B. Referring now to FIG. 9, thereafter, with all four sides of the picture now fully adhered to the corresponding leaves (in this embodiment, the second sub-leaves, though the first sub-leaves, or more distal sub-leaves such as the third sub-leaves may also be used), the leaves are then folded upwardly (upwardly in the picture, yet rearwardly with respect to the display panel 12) to create the spars 40C, D (in the manner described above). This process has the effect of tensioning the web from which the picture is formed between the spars 40C, D. Referring to FIGS. 10 and 11, with the picture adhered to them, the leaves 20A, B are then folded rearwardly to create the spars 40A, B which then interlock with the spars 40C, D in the manner described above. This then causes the flexible web of hard copy material from which the picture is formed to be tensioned between the spars 40A, B.

In the present embodiment, the attachment regions are located on the second sub-leaves. This has the advantage that these regions, once the spars are formed and interlocked, will be located behind the display panel and so will not be visible. However, attachment regions on the first sub-leaves, or more distal sub sub-leaves such as the third sub-leaves, is also possible.

It can be seen that the aforementioned embodiment provides both a picture mounting and a method of picture mounting enabling easy location and adhesion of the picture and, in addition, provides a self-tensioning mounting to ensure that the picture is retained flat and taught against the display surface. Typically, therefore, the picture will be formed of a web of hard copy material that is flexible, often more flexible than the web of material forming the mounting. However, this is not essential and the picture can be formed of a less flexible web provided that, once the picture is attached to the attachment regions of the leaves on the mounting, the leaves of the mounting are structurally capable of being folded rearwards and interlocked to create the spars which then retain their shape and function as a frame.

In an alternative embodiment, the image is recorded directly onto the display surface of the display panel on the mounting, thus obviating the need for a picture distinct from the mounting. Preferably, in such an embodiment, the mounting does not include the adhesive strips 200A, B, C, D and associated release paper, since there is no picture to fasten to the mounting.

Figure 12:
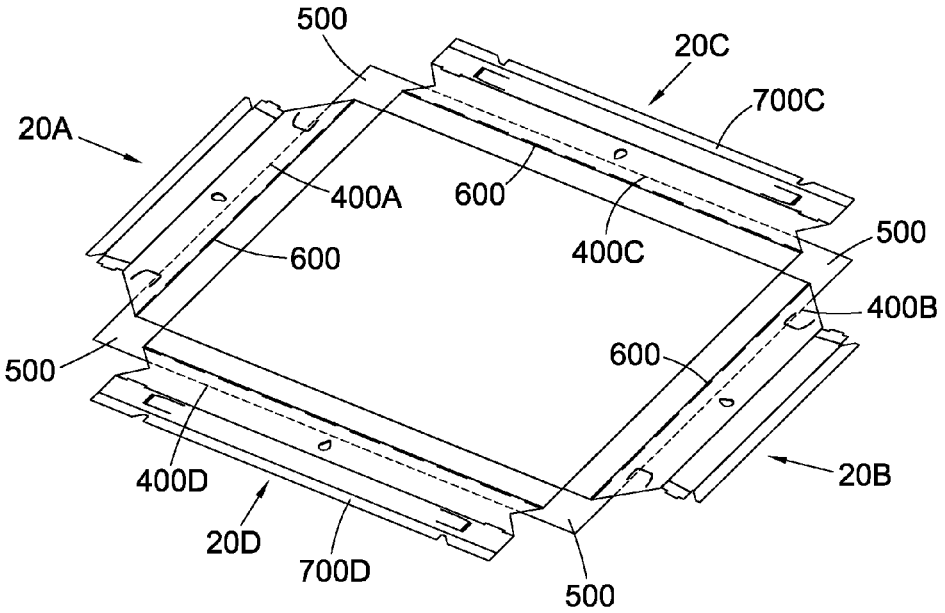
FIGS. 12 to 14 are perspective views of a modified mounting and mounting method according to a further embodiment of the present invention.
Figure 13:
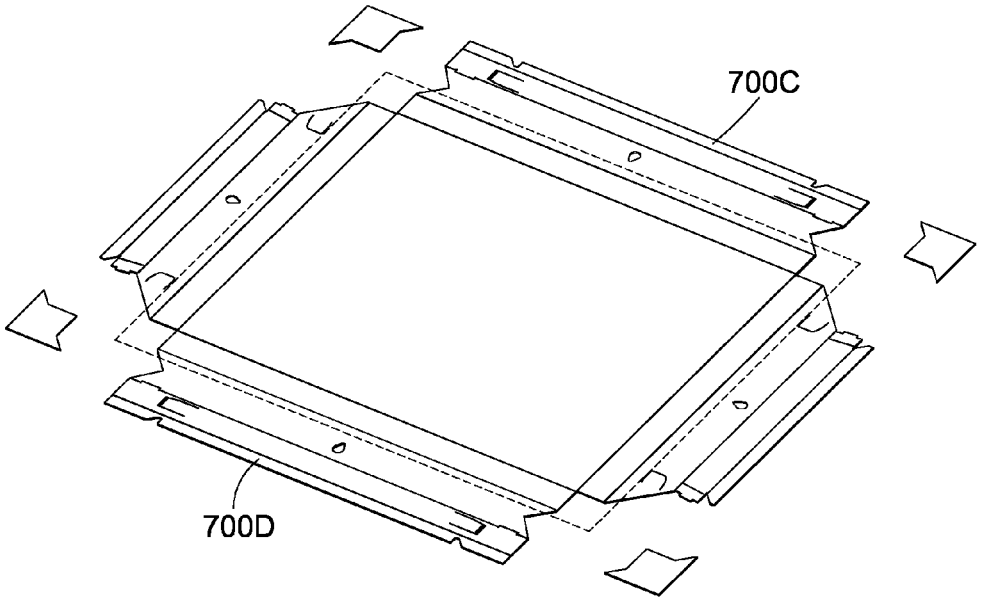
Figure 14:
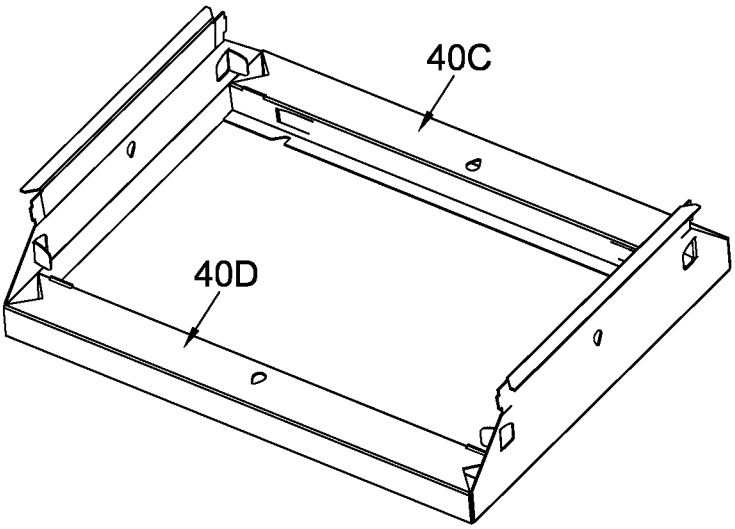

In yet a further embodiment, a picture is fastened to the mounting in an alternative manner which does not require adhesive. Referring now to FIGS. 12 to 14, a cardboard web which provides a mounting has a very similar construction to those illustrated in the embodiments illustrated and described in connection with FIGS. 1 to 11. The mounting is shown in FIG. 11 with the display surface of the display panel 12 facing downwards. A picture 400 is located beneath the unassembled mounting, the edges 400A-D of the picture 400 being visible as dashed lines in FIGS. 12 and 13. The picture 400 is located precisely relative to the mounting by means of alignment surfaces, provided in the present example by four corner guides 500 (though, depending upon the relative sizes of the display panel and picture and the surfaces, a minimum of one such corner guide providing two alignment surfaces would suffice to ensure proper alignment). Each corner guide 500 is detachable from the remainder of the web from which the mounting is formed by the use of only moderate force as a consequence of the part cutting operation which defines the guides 500.

Once the picture 400 is located by reference to the guides, it is then attached to the mounting. In one preferred manner of attachment according to the present embodiment, the picture and mounting are attached using staples 600 along a perimeter close to the picture edges 400A, D, the staples. Once the picture 400 has been stapled, the corner guides 500, having served their locating function, are then removed. Typically this simply done manually by pulling them and causing the part cut boundary defining them to give way.

Next, the release paper is removed from the strips 700C, D of adhesive, located on the rearward-facing edges (pictured facing upwardly in FIGS. 12 to 14) of the distal leaves 42C, D of the leaves 20C, D. The leaves 20C, D are then folded rearwardly about the fold lines 22C, D and pressed into adhesive contact with the rear face of the display panel 16 to enable the creation of a box-sectioned spars 40C, D as described previously. The remainder of the mounting, including the mutual interlocking of the spars, is then undertaken as previously described. The attachment of the picture to the mounting by means of staples 600 provides the same or substantially the same effect as the adhesive strips of the earlier embodiment. Thus, the assembly of the mounting with the picture attached, involving rearward folding of the various leaves of the web forming the mounting to create the spars, causes a 'self-tensioning' effect upon the picture which ensures that the picture is held taught across the display panel.

Figure 15:
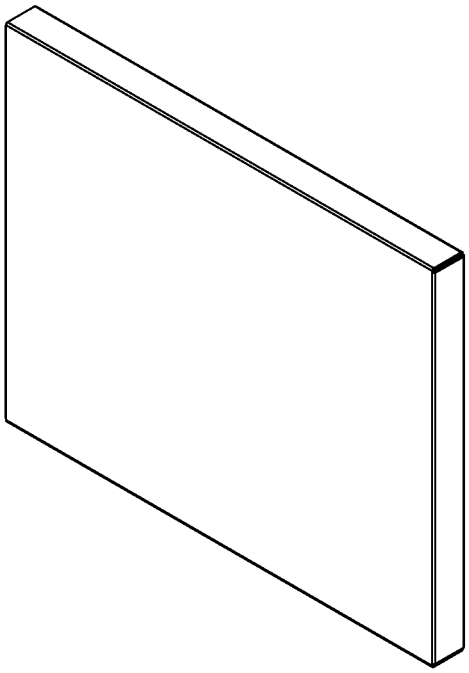
FIG. 15 is a frontal perspective view of a mounted picture.

Referring now to FIG. 15 a mounted picture is shown. It can be seen that where the attachment of the picture is to the second, or more distal sub-leaves, even where the attachment is by means which would ordinarily be visually identifiable, such as staples, it is located to the rear of the picture and therefore is invisible, whilst simultaneously providing the self-tensioning benefits. Attachment by means of self-adhesive strips is, of course, invisible even if located on the first sub-leaves, though as mentioned previously, these are only preferred embodiments and all forms of attachment to any sub-leaf is possible, including a mixture of sub-leaves (thus one side may be attached to the second sub-leaf and another to the first or third, or any combination thereof as desired and advantageously employed in the circumstances).

The invention claimed is:

1. A mounting retaining a picture, which picture comprises a display substrate of hard copy material upon which an image is recorded, the mounting having:

a support substrate having a display panel which has a display surface on its front face, the display panel having a perimeter defined by a frame having a plurality of spars;

each spar being made of leaves created from the support substrate and extending from the perimeter of the display panel, each of the leaves being folded at least twice, in a rearward direction to create a spar having a polygonal cross-section;

each spar having an attachment region located on a surface of one of the leaves and to which the picture is attached to the respective spar;

the spars being mutually interlocking behind the front surface of the display panel thereby to create the frame and to tension the picture, wherein the leaves include mutually engageable elements which, upon folding in the rearward direction, create mutual interlocking of the spars, and wherein the mutually engageable elements provide a cam action to draw at least two of the spars into location against a rearward facing surface of the display panel.

2. A picture mounting according to claim 1 wherein the attachment regions are provided by adhesive regions which enable adhesive attachment of the picture to the respective leaf.

3. A picture mounting according to claim 2 wherein the adhesive regions are strips of adhesive extending substantially parallel to the perimeter of the display panel.

4. A picture mounting according to claim 1 wherein the polygonal cross section of each spar is a quadrilateral.

5. A picture mounting according to claim 1 wherein the display panel is rectangular.

6. A picture mounting according to claim 1 wherein each of the leaves has a pair of locating surfaces to enable alignment of the picture prior to attachment of the picture to the leaves.

7. A picture mounting according to claim 1 wherein rearward folding of the leaves subsequent to adhesion of the picture to the leaves causes tensioning of the picture thereby to retain the picture flat and taught against the display panel.

8. A picture mounting according to claim 1 comprising staples for the attachment of the picture to the attachment region of the spars.

9. A picture mounting according to claim 1 wherein each leaf has first sub-leaf defined by a first fold which extends between the leaf and the display panel and a second sub-leaf defined by a second fold which extends between the first sub-leaf and the second sub-leaf, and the attachment regions are located on the second sub-leaf.

10. A display assembly comprising the mounting of claim 1 and display substrate made of canvas.

11. A method of mounting a picture upon a display surface, the method comprising the steps of:

providing a mounting comprising:

a support substrate having a display panel which has a display surface on its front face, the display panel having a perimeter defined by a frame having a plurality of spars;

each spar being made of leaves created from the support substrate and extending from the perimeter of the display panel, each of the leaves configured to be folded at least twice, in a rearward direction to create a spar having a polygonal cross-section;

each spar having an attachment region located on a surface of one of the leaves and configured to attach to the picture at each respective spar;

the spars being mutually interlocking behind the front surface of the display panel thereby to create the frame and to tension the picture, wherein the leaves include mutually engageable elements which, upon folding in the rearward direction, create mutual interlocking of the spars, and wherein the mutually engageable elements provide a cam action to draw at least two of the spars into location against a rearward facing surface of the display panel aligning the picture and the leaves by bringing alignment surfaces on the leaves into register with adjacent edges of the picture;

with the picture and leaves in mutual alignment, attaching the picture to the leaves;

subsequent to attachment of the picture to the leaves, folding the leaves rearwardly of the display surface, to create spars having a polygonal cross section; and mutually interlocking the spars.

12. A method according to claim 11 wherein the step of attaching the picture to the leaves comprises the step of removing release paper from self-adhesive strips located on the leaves and folding the picture into contact with consequently exposed adhesive strips located on the leaves.

13. A method according to claim 11 wherein the step of attaching the picture to the leaves comprises the step of stapling the picture to the leaves.

14. A method according to claim 11 wherein each leaf has first sub-leaf defined by a first fold which extends between the leaf and the display panel and a second sub-leaf defined by a second fold which extends between the first sub-leaf and the second sub-leaf, and the picture is attached to the leaves on the second sub-leaves.

15. A method according to claim 11 wherein the step of interlocking the spars occurs during the step of rearwardly folding the leaves to create the spars.

16. A method according to claim 11, wherein the picture is made of a canvas.

* * * * *